US007174677B1

(12) United States Patent
Dressler

(10) Patent No.: US 7,174,677 B1
(45) Date of Patent: Feb. 13, 2007

(54) SNOW GUARD FOR SHINGLED ROOFS

(75) Inventor: Robert D. Dressler, Mechanicsburg, PA (US)

(73) Assignee: Amerimax Home Products, Inc., Lancaster, PA (US)

( * ) Notice: Subject to any disclaimer, the term of this patent is extended or adjusted under 35 U.S.C. 154(b) by 421 days.

(21) Appl. No.: 10/665,768

(22) Filed: Sep. 17, 2003

(51) Int. Cl.
*E04D 13/076* (2006.01)
*E04D 13/10* (2006.01)

(52) U.S. Cl. ..... 52/26; 52/24

(58) Field of Classification Search ..... 52/24, 52/25, 26; 248/237, 205.3, 148
See application file for complete search history.

(56) References Cited

U.S. PATENT DOCUMENTS

| | | | | | |
|---|---|---|---|---|---|
| 97,316 | A | | 11/1869 | Rogers | |
| 390,061 | A | * | 9/1888 | Bower | 52/24 |
| 473,512 | A | * | 4/1892 | Laird | 52/25 |
| 507,776 | A | * | 10/1893 | Rock | 52/24 |
| 706,684 | A | * | 8/1902 | Peter | 52/24 |
| 1,366,703 | A | * | 1/1921 | Peter | 52/24 |
| 1,463,065 | A | * | 7/1923 | Sieger | 52/24 |
| 1,863,561 | A | * | 6/1932 | Brinker et al. | 52/24 |
| 2,079,768 | A | | 5/1937 | Levow | 108/27 |
| 3,296,750 | A | * | 1/1967 | Zaleski | 52/24 |
| 3,373,532 | A | * | 3/1968 | Strange | 52/24 |
| 4,141,182 | A | * | 2/1979 | McMullen | 52/24 |
| D314,506 | S | * | 2/1991 | McMullen | D8/499 |
| 5,044,130 | A | * | 9/1991 | Chiddister | 52/24 |
| 5,282,340 | A | * | 2/1994 | Cline et al. | 52/24 |
| 5,343,659 | A | * | 9/1994 | Zaleski | 52/24 |
| 5,371,979 | A | * | 12/1994 | Kwiatkowski et al. | 52/24 |
| D364,338 | S | * | 11/1995 | Cline | D8/499 |
| 5,522,185 | A | | 6/1996 | Cline | 52/24 |
| D372,421 | S | | 8/1996 | Cline | D8/499 |
| 5,655,334 | A | * | 8/1997 | Kwiatkowski | 52/24 |
| D419,863 | S | * | 2/2000 | Mullane | D8/499 |
| 6,070,368 | A | * | 6/2000 | Anderson | 52/24 |
| 6,266,929 | B1 | * | 7/2001 | Cline | 52/24 |
| 6,453,623 | B1 | * | 9/2002 | Nelson et al. | 52/24 |
| 6,499,259 | B1 | * | 12/2002 | Hockman | 52/26 |
| 6,584,737 | B1 | * | 7/2003 | Bradley, Jr. | 52/173.3 |
| 6,715,254 | B2 | * | 4/2004 | Regular | 52/639 |
| D495,595 | S | * | 9/2004 | Dressler | D8/499 |
| D519,025 | S | * | 4/2006 | Dressler | D8/499 |
| 7,127,852 | B1 | * | 10/2006 | Dressler | 52/24 |

FOREIGN PATENT DOCUMENTS

| | | | | |
|---|---|---|---|---|
| EP | 52080 | * | 5/1982 | 52/24 |

(Continued)

*Primary Examiner*—Phi Dieu Tran A
(74) *Attorney, Agent, or Firm*—Miller Law Group, PLLC

(57) ABSTRACT

A snow guard for a shingled roof in which the flat attachment strap positionable between layers of shingles has mounted thereon a detachable mounting bracket that projects upwardly from the attachment strap. The body portion of the mounting bracket has a wedge-shaped receptacle on the top surface to mount devices such as a snow guard attachment, which can be locked into place on the mounting bracket by a threaded fastener that passes through the mounting bracket into the base of the snow guard attachment. The snow guard attachment can be easily replaced with aesthetically different snow guard members or a snow fence that spans across several aligned mounting brackets.

15 Claims, 5 Drawing Sheets

FOREIGN PATENT DOCUMENTS

| | | | | |
|---|---|---|---|---|
| JP | 58-168447 | * 10/1983 | ..... | 52/24 |
| JP | 1-247644 | * 10/1989 | ..... | 52/24 |
| JP | 3-76963 | * 4/1991 | ..... | 52/24 |
| SE | 631226 | * 7/1982 | ..... | 52/24 |
| WO | WO 93/22524 | * 11/1993 | ..... | 52/24 |

* cited by examiner

SNOW GUARD FOR SHINGLED ROOFS

BACKGROUND OF THE INVENTION

This invention relates generally to a snow guard for attachment to a shingled roof and, more particularly, to a mounting bracket and snow guard attachment that replicates a raised seam roof snow guard.

Raised seam roofs are formed with panels manufactured from sheet metal or other suitable building materials with a flat panel that runs from the peak of the roof to the lower edge thereof. These panels are joined together by a formed edges that projects upwardly above the flat surface of the panel. The formed edges of adjacent panels are interlocked to fix the panels together in a sealed seam that is raised above the otherwise planar surface of the panels. Clips can be connected to the raised seams to tie into the frame structure of the building immediately beneath the seams, thereby fixing the roofing material which the panels form to the building. The sealed seams and the lower planar surfaces of the panels provide a watertight barrier against moisture provided that the panels, including the raised seams, are not punctured. Attaching devices to a raised seam roof without puncturing the panels or the sealed raised seams is a problem that has been appreciated for many years.

Raised seam roofs with the planar surfaces running from the roof peak to the roof edge do not retain snow on the roof surface as any accumulated snow tends to slide downwardly along the planar surfaces, particularly after the snow has partially melted to form a moisture layer between the roof panels and the accumulated snow. One of the most frequently needed devices to be attached to raised seam roofs is a snow guard which is operable to restrict the movement of accumulated snow off the roof panels. Other devices are often needed to be mounted on the roof, such as lightening rods, antennas, or support structures for both people and other apparatus such as air conditioners, etc. A device that can engage the raised seam roof to permit such devices to be mounted thereon without causing the roof or the raised seam thereof to be perforated has been contemplated for many years.

One of the early mechanisms for mounting devices on raised seam roofs can be found in U.S. Pat. No. 1,330,309, issued to R. T. Dixon on Feb. 10, 1920. The Dixon mechanism includes an elongated channel member having a cavity formed therein to receive the raised seam portion of the roof panel structure. A mounting bolt is received within a transverse threaded bore to engage the raised seam portion within the cavity of the channel member to deform the raised seam into a formed pocket, thereby affixing the channel member to the raised seam portion of the roof. A board rest member is formed as part of the channel member to permit the detachable mounting of devices, such as a snow guard, to the channel member.

A number of patents, including U.S. Pat. No. 5,228,248; U.S. Pat. No. 5,483,772; U.S. Pat. No. 5,491,931; U.S. Pat. No. 5,983,588; and U.S. Pat. No. 6,164,033 were issued to Robert M. M. Haddock for a mounting member that, like the Dixon patent, is affixed to the raised seam portion of a roof structure without puncturing the surface of the roof panels by a fastener that engages and deforms the raised seam portion. The Haddock mounting members typically require two fasteners for stability and are formed with cavities extending through the body of the mounting member to attach devices, such as a snow fence or decorative attachments, to the mounting member.

U.S. Pat. No. 5,282,340; U.S. Pat. No. D364,338; U.S. Pat. No. D372,421; and U.S. Pat. No. 5,522,185 were issued to Roger M. Cline, et al. for various configurations of snow guards which are formed to be mounted on the raised seam portion of a roof structure. Like the Dixon and Haddock patents, the mounting of the snow guard involves the utilization of a fastener that is threaded into a body portion of the snow guard to engage and deform the raised seam portion of the roof structure to affix the snow guard to the roof. The snow guard structure includes a transversely extending body manufactured in a formed shape to present an esthetically pleasing device to be exposed on the surface of the roof.

U.S. Pat. No. 884,850, issued on Apr. 14, 1908, to F. A. Peter, is directed to a snow guard having a body member that straddles a raised seam portion of a roof to mount the snow guard without piercing the surface of the roof or the seam structure. The body member is formed in two opposing halves and is clamped onto the raised seam by a bolt that passes above the seam to interengage the opposing sides of the body member and effect a clamping action on the seam structure. While the Peter mechanism does not cause a deformation of the raised seam structure of the roof, the clamping action is indirect and does not provide a substantial affixation of the snow guard to the roof structure.

Shingled roofs, such as is found on conventional house roofs, do not have the raised seam structure that is prevalent in the aforementioned raised seam roof construction. Shingled roofs are formed from overlapping advancing layers of fiberglass, asphalt, plastic, slate, wood, metal or other composite material shingles that are applied to a roof structure. As is shown in U.S. Pat. No. 2,079,768, granted to David Levow on May 11, 1937, snow guards for shingled roofs are formed with a flat attachment strap that is positioned between the layers of shingles and nailed to the roof structure. As seen in U.S. Pat. No. 97,316, granted to Andrew Rogers on Nov. 30, 1869; in U.S. Pat. No. 473,512, granted to John Laird on Apr. 26, 1892; and in U.S. Pat. No. D364,338, granted to Roger Cline on Nov. 21, 1995, such snow guards are typically one-piece members that do not lend themselves to flexibility in utilization.

Accordingly, it would be desirable to provide a snow guard structure for shingled roofs that will replicate the advantages of snow guards on raised seam roofs and provide flexibility in use and in aesthetic selection.

SUMMARY OF THE INVENTION

It is an object of this invention to overcome the disadvantages of the prior art by providing a snow guard for a shingled roof in which the snow guard attachment is replaceable.

It is another object of this invention to provide a mounting bracket for mounting devices to an attachment strap that is used to affix a snow guard to a shingled roof structure.

It is a feature of this invention that the mounting bracket detachably mounts to the attachment strap by fasteners.

It is still another object of this invention to provide a mounting bracket that has a universal nature in accommodating a variety of sizes and shapes of snow guard attachments.

It is further feature of this invention that the implement mounting system is formed with a wedge-shaped opening and a fastener that locks an implement to the top of the mounting bracket.

It is a still another advantage of this invention that the implement or device to be mounted on top of the mounting bracket can be quickly and easily replaced.

It is a further object of this invention to provide a snow guard device that can be attached to a mounting bracket to retain snow on the surface of an inclined shingled roof structure.

It is still a further object of this invention to provide a snow guard for a shingled roof structure, which is durable in construction, inexpensive of manufacture, carefree of maintenance, facile in assemblage, and simple and effective in use.

These and other objects, features and advantages are accomplished according to the instant invention by providing a snow guard for a shingled roof in which the flat attachment strap positionable between layers of shingles has mounted thereon a detachable mounting bracket that projects upwardly from the attachment strap. The body portion of the mounting bracket has a wedge-shaped receptacle on the top surface to mount devices such at a snow guard attachment, which can be locked into place on the mounting bracket by a threaded fastener that passes through the mounting bracket into the base of the snow guard attachment. The snow guard attachment can be easily replaced with aesthetically different snow guard members or a snow fence that spans across several aligned mounting brackets.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Referring now to FIGS. 1–5, a snow guard structure for use with shingled roofs, incorporating the principles of the instant invention, can best be seen. The primary attachment structure for the snow guard assembly 10 is an attachment strap 12 having holes 13 extending therethrough to permit the attachment strap 12 to be positioned between layers of shingles (not shown) and nailed to the underlying roof structure with nails (not shown) passing through the holes 13 to affix the attachment strap 12 to the shingled roof (not shown) in a manner that will not incur leaks through the roofing structure.

Figure 1:
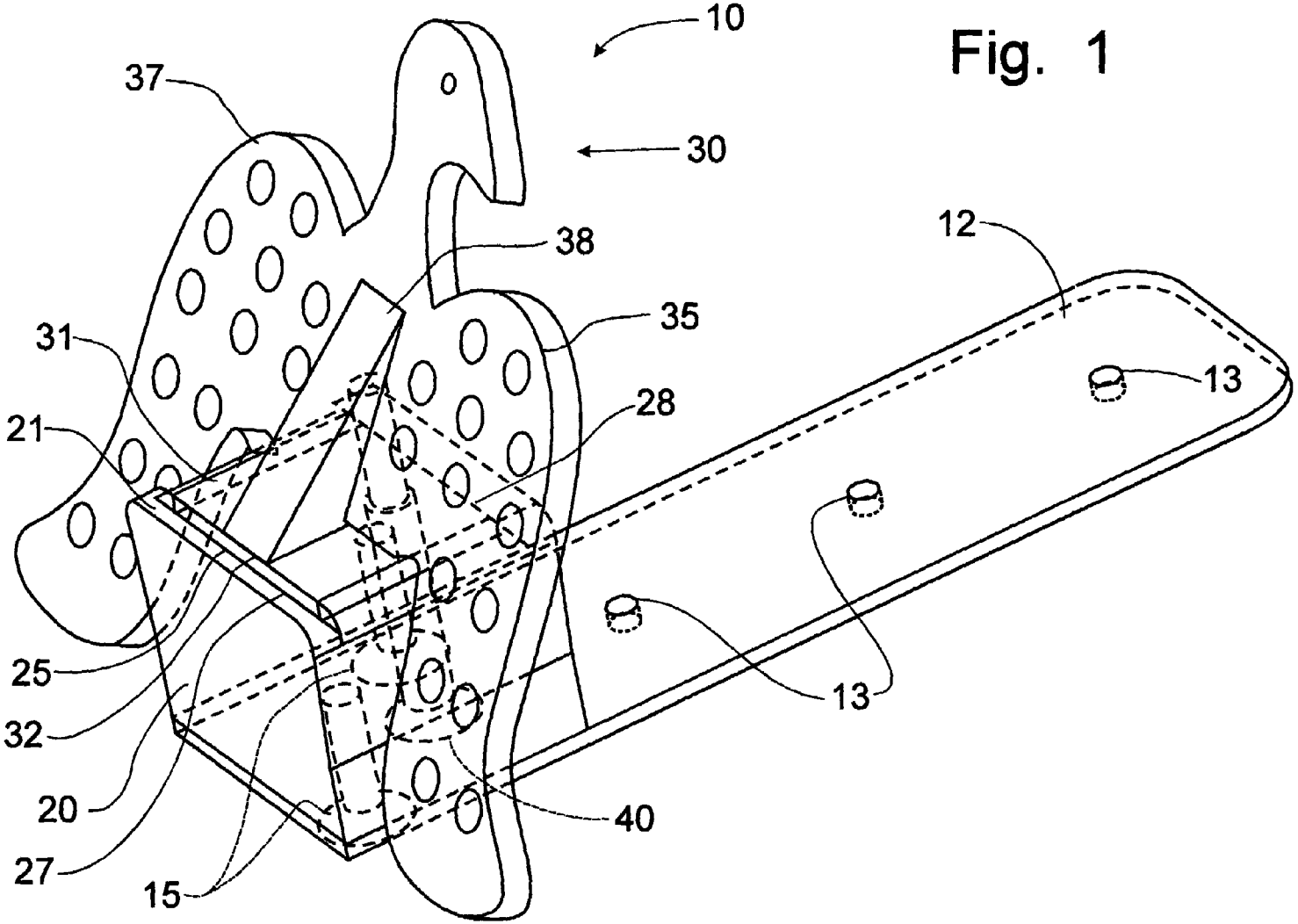
FIG. 1 is a perspective view of a snow guard incorporating the principles of the instant invention, the assembled snow guard apparatus includes a mounting bracket detachably fastened to the attachment strap with a removable eagle-shaped snow guard attachment mounted on the mounting bracket.
Figure 3:
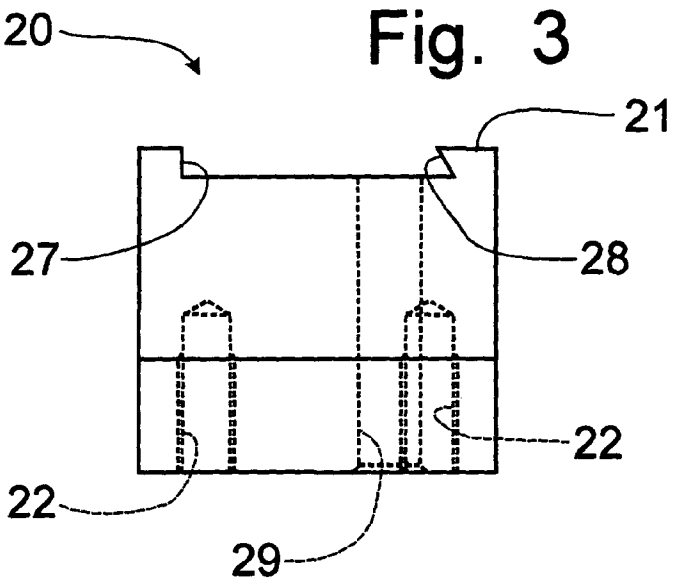
FIG. 3 is a right side elevational view of the mounting bracket of FIG. 2.
Figure 2:
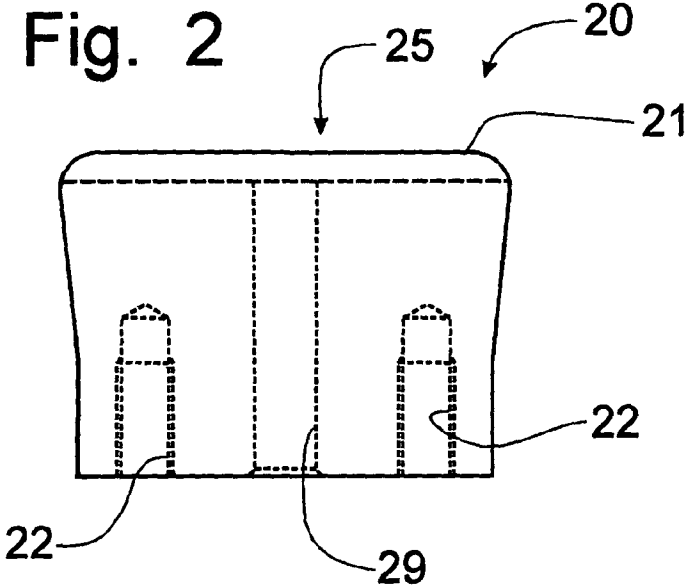
FIG. 2 is a rear elevational view of the mounting bracket depicted in FIG. 1 with the fastener openings being shown in phantom.
Figure 4:
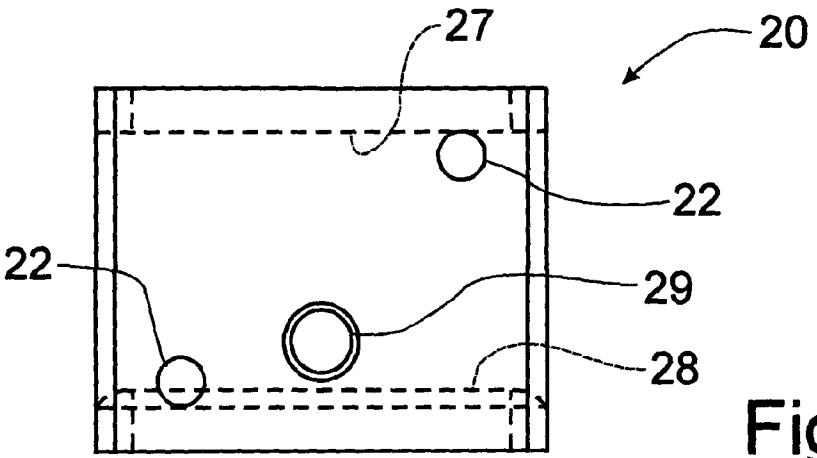
FIG. 4 is a bottom plan view of the mounting bracket of FIG. 2.
Figure 5:
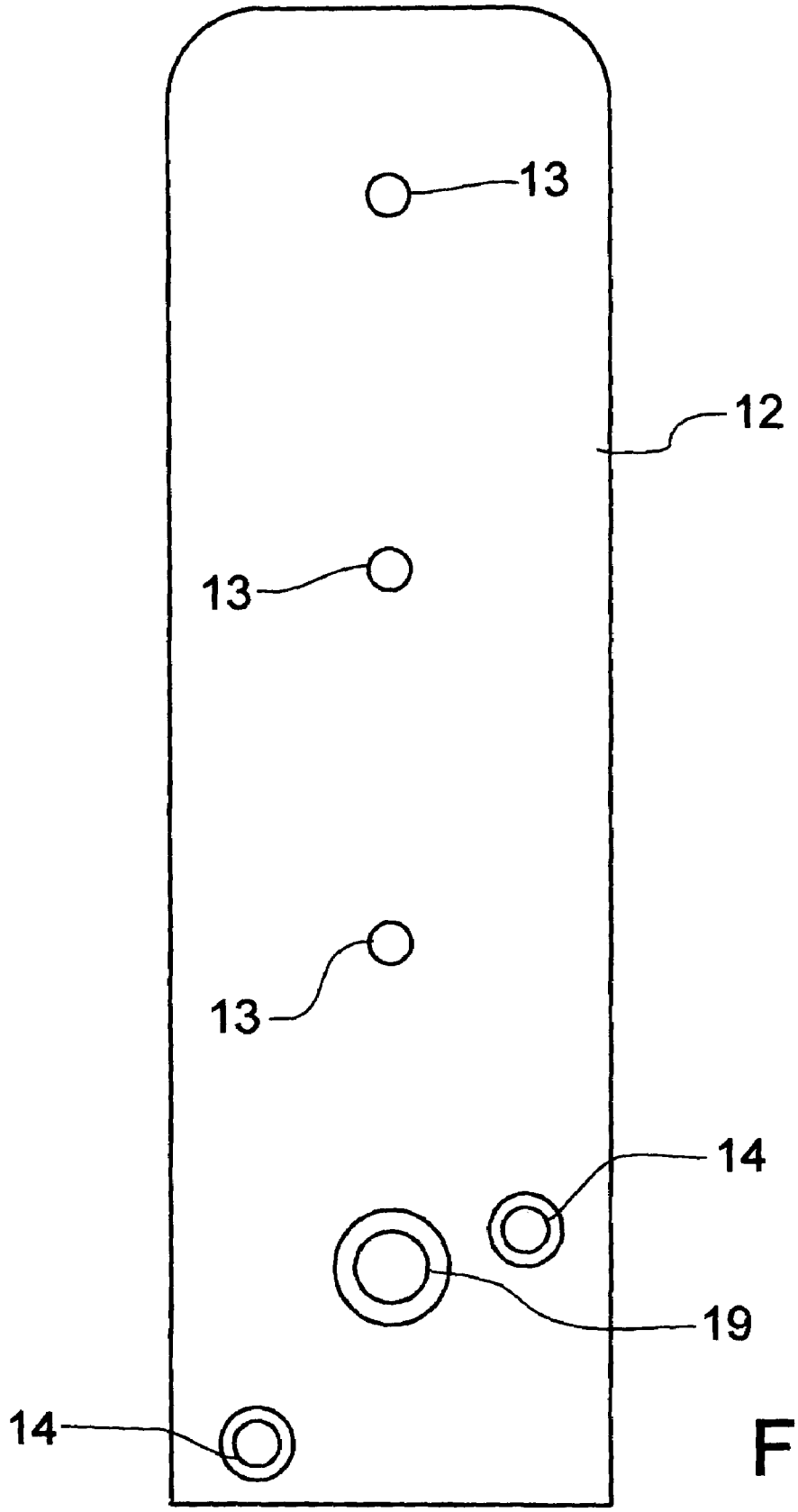
FIG. 5 is a plan view of the attachment strap.
Figure 6:
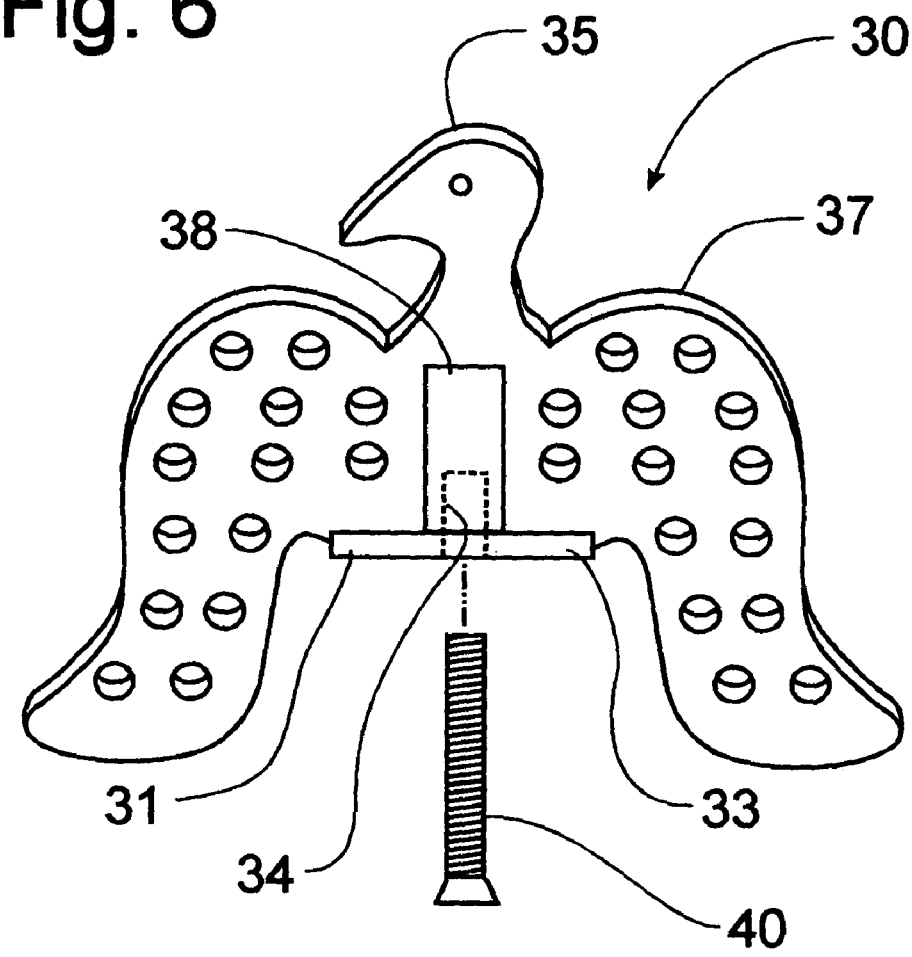
FIG. 6 is an elevational view of the snow guard attachment for mounting in the mounting receptacle of the mounting bracket.
Figure 7:
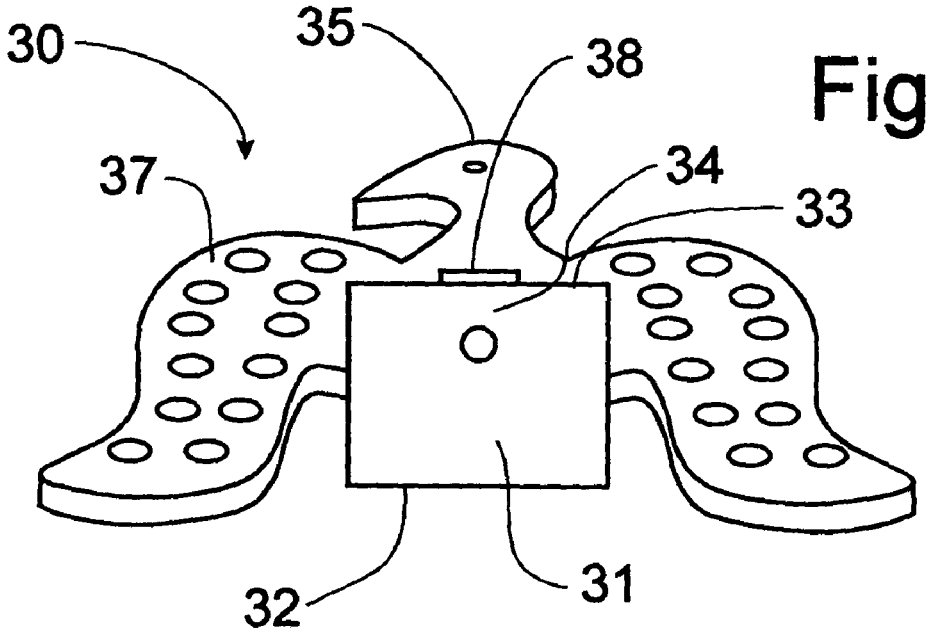
FIG. 7 is a bottom plan view of the snow guard attachment of FIG. 6.

The attachment strap 12, as is best seen in FIG. 5, is also provided with a pair of fastener openings 14 through which corresponding fasteners 15 can pass to threadably engage corresponding openings 22 within the mounting bracket 20. Thus, the fasteners 15 detachable connect the mounting bracket 20 to the attachment strap 12 at one end thereof which would protrude from between the layers of shingles (not shown). The top surface 21 of the mounting bracket 20 is formed with an attachment receptacle 25 for mounting implements and/or attachments to the mounting bracket 20. The attachment receptacle 25 is formed as a relief depression into the top surface 21. The depression preferably extends across the entire top surface 21 of the mounting bracket 20 and has a first generally vertical edge 27 and an inwardly beveled wedging edge 28 opposite to the vertical edge 27. The attachment receptacle 25 is operable to receive an attachment formed with a correspondingly matched base member 31, as will be described in greater detail below.

The mounting bracket 20 is also formed with a fastener opening 29 that passes through the mounting bracket from top to bottom to align with a corresponding opening 19 in the attachment strap 12. A long fastener 40 can pass through the attachment strap 12 and through the entire body of the mounting bracket 20 to engage a threaded opening 34 in the base 31 of the snow guard attachment 30 to detachably fasten the snow guard attachment 30 to the mounting bracket. By trapping a correspondingly shaped edge of the base 31 of the snow guard attachment underneath the wedging edge 28 and locking the base 31 to the attachment receptacle 25, the snow guard attachment 30 is securely fixed as part of the snow guard assembly 10.

A representative snow guard attachment 30 in the form of an eagle-shaped snow retention member 35 can be seen in FIGS. 6–9. The snow retention member 35 is formed in a transversely extending body 37 having a shape that extends laterally of the mounting bracket 20 and projects downwardly to come into close proximity or into engagement with the flat surface (not shown) of the roof to either side of the mounting bracket 20 to which the snow retention member 35 is to be mounted. In the configuration depicted in FIGS. 6–9, the transversely extending body 37 of the snow retention member 35 is shaped like a bird whose wings 38 extend downwardly. The body 37 is integrally formed with the base member 31 that is configured to be received within the attachment receptacle 25 on the top surface 21 of the mounting bracket 20. The base member 31 is formed with a first generally perpendicular edge 32 that corresponds to the vertical edge 27 of the attachment receptacle 25 on the top surface 21 of the mounting bracket 20, and with a beveled edge 33 that corresponds to the wedging edge 28.

Figure 8:
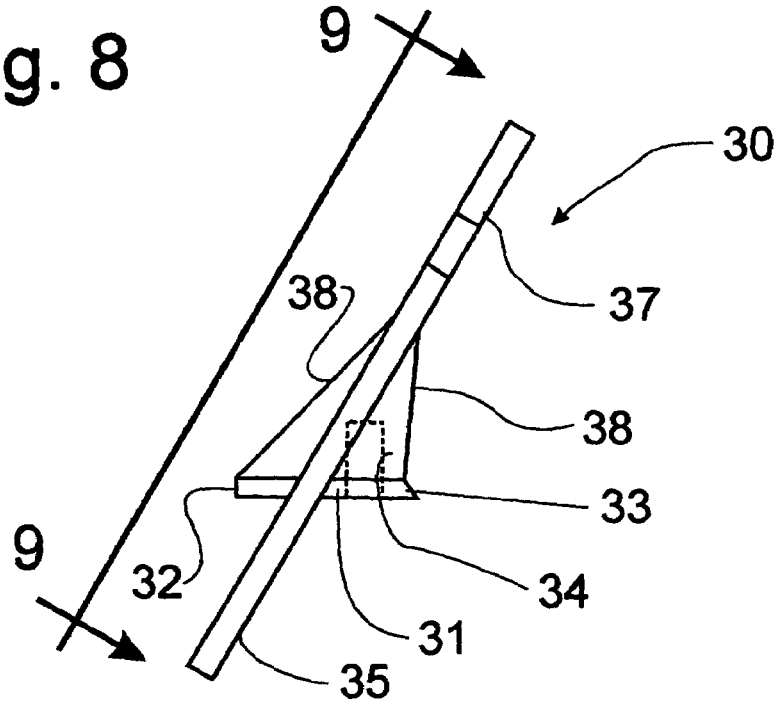
FIG. 8 is a side elevational view of the snow guard attachment orthogonal to the view of FIG. 6 and corresponding to lines 8—8 of FIG. 9.
Figure 9:
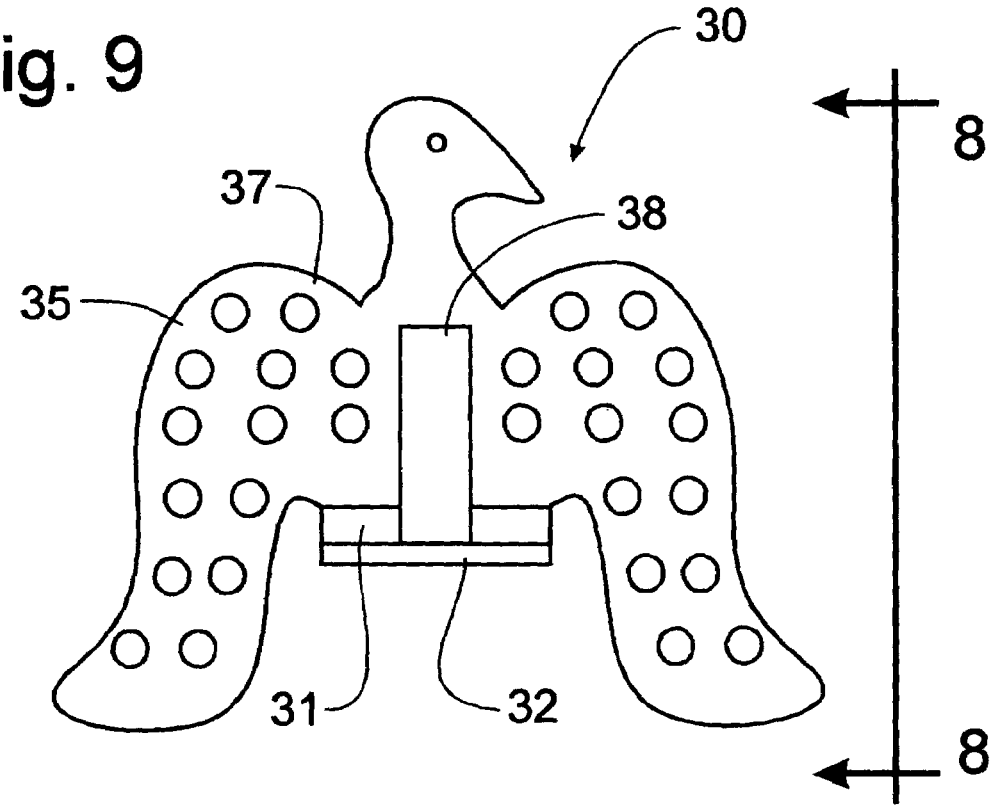
FIG. 9 is a rear elevational view of the snow guard attachment looking perpendicularly to the body portion of the attachment, corresponding to lines 9—9 of FIG. 8.

The body 37 is angled preferably at about 60 degrees to the base member 31, as is best seen in FIG. 8, to orient the body 37 in a more perpendicular orientation with respect to the plane of the roof when attached to a mounting bracket 20. If, for example, the roof was pitched at a 30 degree angle, the body 37 would then be literally perpendicular to the plane of the roof to provide resistance to the movement of snow downwardly over the surface of the roof. To resist the bending forces that are exerted on the body 37 of the snow retention member 35, integral braces 38 extend fore-and-aft between the body 37 and the base member 21. The brace 38 on the uphill side of the snow retention member 35 will receive the threaded passage 34.

One skilled in the art will readily recognize that many different attachments can be formed with a base member 31 that can be received by the attachment receptacle 25. Snow guards 35 can be formed in many different shapes and sizes for mounting on the mounting bracket 20. A snow fence (not shown), which would be equipped with a plurality of base members 31 that would be received with a corresponding number of mounting brackets 20 mounted generally parallel to the peak of the roof structure, would be an alternative example of a snow guard. Other attachments can be antennas, display signs, air conditioning units, ladders and walk ways. All such configured attachments can be quickly and easily attached to the mounting bracket by receiving the base member into the attachment receptacle 25 and connecting the locking fastener 40 to fix the base member 31 to the top surface 21 of the mounting bracket 20.

For assembly, the mounting bracket 20 is affixed to the attachment receptacle 25 by inserting the fasteners 15 through the holes 14 in the attachment strap 12 and into engagement with the threaded openings 22 in the mounting bracket 20. The snow retention member 35 is then attached to the mounting bracket 20 by slipping the base member 31 into the attachment receptacle 25 on the top surface 21 of the mounting bracket 20 with the beveled edge 33 positioned underneath the wedging edge 28. The locking fastener 40 is then inserted through the opening 19 in the attachment strap and then through the opening 29 through the mounting bracket 20 into the threaded passage 34 in the base member 31 of the snow retention member 35, thus fixing the base member 31 to the top surface 21 of the mounting bracket 20. One skilled in the art will readily recognize that a different form of attachment could utilize a locking fastener 40 that is inserted through the attachment from above the mounting bracket 20 and engaged into the aperture 34 which would be threaded to engage the locking fastener 40. In such a configuration, however, the locking fastener 40 would not be protected from beneath the top surface 12 of the mounting bracket 20.

The attachment strap 12 can then be inserted between layers of shingles and nailed into position with roofing nails, or the like, being inserted through the nail holes 13 in the attachment strap 12 and into the roof structure (not shown). The lower end of the snow guard assembly 10, including the mounting bracket 20 with the snow retention member 35 mounted thereon is left projecting out of the layered shingles for engagement with the snow accumulated on the roof to restrict movement thereof downwardly to the ground.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. A snow guard assembly for attachment to a roof having layered shingles covering an underlying roof structure, comprising:

an attachment strap for inserting between layers of shingles, said attachment strap having an apparatus for securing said attachment strap to said underlying roof structure;

a mounting bracket detachably connected by threaded fasteners to said attachment strap proximate to one end thereof; and a snow retention member detachably connected to said mounting bracket by a threaded locking fastener inserted through a hole in said attachment strap, said locking fastner passing through said mounting bracket to engage said snow retention member, said snow retention member having a body portion that extends on opposing sides of said mounting bracket.

2. The snow guard assembly of claim 1 wherein said mounting bracket has a top surface formed with an attachment receptacle for receiving said snow retention member.

3. The snow guard assembly of claim 2 wherein said attachment receptacle is formed with a wedging edge to correspond to a beveled edge of said snow retention member.

4. The snow guard assembly of claim 3 wherein said snow retention member comprises:

a base member having said beveled edge on one side thereof;

a body member supported by said base member to extend above and laterally to both sides of said base member; and a brace member interconnecting said base member and said body member to resist loads imposed on said body member.

5. The snow guard assembly of claim 4 wherein said base member is also formed with a generally vertical edge opposite said beveled edge, said attachment receptacle being formed with a corresponding generally vertical edge.

6. The snow guard assembly of claim 5 wherein said locking fastener interengages said attachment strap and said base member, passing through an opening extending through said mounting bracket.

7. A snow retention member mountable on a corresponding mounting member for attachment to a roof structure, comprising:

a base member having a beveled edge on one side thereof, said beveled edge corresponding to a wedging edge in an attachment receptacle formed as part of the mounting member to trap said base member into said attachment receptacle;

a body member supported by said base member to extend above and laterally to both sides of said base member; and a brace member interconnecting said base member and said body member to resist loads imposed on said body member, said brace member extending both in front of and in rear of said body member.

8. The snow retention member of claim 7 wherein said base member is formed with a threaded opening extending generally vertically into said brace member, a locking fastener being interengagable between said mounting member and said threaded opening in said base member to detachable affix said base member in said attachment receptacle.

9. The snow retention member of claim 7 wherein said body member is integrally formed with said brace member and said base member, said body member being oriented on said base member at a non-perpendicular orientation.

10. In a snow guard assembly for attachment to a roof having layered shingles covering an underlying roof structure, said snow guard assembly including an attachment strap for inserting between layers of shingles, said attachment strap having an apparatus for securing said attachment strap to said underlying roof structure, the improvement comprising:

a mounting bracket detachably connected to said attachment strap proximate to one end thereof; and a snow retention member detachably connected to said mounting bracket, said snow retention member having a base member formed with a beveled edge on one side thereof and a body member supported by said base member to extend above and laterally to both sides of said base member, said mounting bracket having a top surface formed with an attachment receptacle for receiving said snow retention member, said attachment receptacle being formed with a wedging edge to correspond to said beveled edge of said base member.

11. The snow guard assembly of claim 10 wherein said snow retention member further includes:

a brace member interconnecting said base member and said body member to resist loads imposed on said body member.

12. The snow guard assembly of claim 11 further comprises:

a locking fastener interengaging said base member and said mounting bracket to secure said snow retention member to said mounting bracket within said attachment receptacle; and a pair of fasteners interconnecting said attachment strap and said mounting bracket for detachably connecting said mounting bracket to said attachment strap.

13. The snow guard assembly of claim 12 wherein said locking fastener interengages said attachment strap and said base member, passing through an opening extending through said mounting bracket.

14. The snow guard assembly of claim 12 wherein said base member is formed with a threaded opening extending generally vertically into said brace member, said locking fastener being interengagable between said mounting member and said threaded opening in said base member to detachable affix said base member in said attachment receptacle.

15. The snow guard assembly of claim 14 wherein said body member is integrally formed with said brace member and said base member, said body member being oriented on said base member at a non-perpendicular orientation.

* * * * *